US006499964B2

(12) United States Patent
Staton et al.

(10) Patent No.: US 6,499,964 B2
(45) Date of Patent: Dec. 31, 2002

(54) INTEGRATED VANE PUMP AND MOTOR

(75) Inventors: Timothy Matthew Staton, Ypsiltanti, MI (US); James Richard Robertson, Walled Lake, MI (US); Bernard Dale Baughn, Livonia, MI (US); John Harvey Lee, Farmington Hills, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/811,315

(22) Filed: Mar. 16, 2001

(65) Prior Publication Data

US 2002/0131873 A1 Sep. 19, 2002

(51) Int. Cl.[7] ..... F04B 49/00
(52) U.S. Cl. ..... 417/310; 417/410.3; 418/259
(58) Field of Search ..... 417/310, 410.3, 417/360; 418/259, 133

(56) References Cited

U.S. PATENT DOCUMENTS

| | | | | | |
|---|---|---|---|---|---|
| 2,852,183 | A | * | 9/1958 | Breinig et al. | 418/236 |
| 3,567,350 | A | * | 3/1971 | Niemiec | 418/112 |
| 4,347,047 | A | | 8/1982 | Shiowaza et al. | 417/310 |
| 4,347,048 | A | | 8/1982 | Kawabata et al. | 417/310 |
| 4,373,871 | A | | 2/1983 | Christ | 417/310 |
| 4,416,598 | A | | 11/1983 | Merz | 418/132 |
| 4,496,288 | A | | 1/1985 | Nakamura et al. | 417/288 |
| 4,505,655 | A | | 3/1985 | Honaga et al. | 418/133 |
| 5,013,222 | A | * | 5/1991 | Sokol et al. | 417/366 |
| 5,111,660 | A | | 5/1992 | Gettel | 60/468 |
| 5,147,183 | A | | 9/1992 | Gettel | 417/300 |
| 5,171,131 | A | * | 12/1992 | Niemiec | 417/283 |
| 5,192,196 | A | | 3/1993 | Gettel | 417/300 |
| 5,267,840 | A | | 12/1993 | Snow et al. | 417/310 |
| 5,290,155 | A | | 3/1994 | Snow et al. | 418/82 |
| 6,135,726 | A | * | 10/2000 | Robertson et al. | 417/360 |
| 6,149,409 | A | | 11/2000 | Palakodati et al. | 418/15 |
| 6,179,581 | B1 | * | 1/2001 | Schnittger et al. | 417/360 |
| 6,257,364 | B1 | * | 7/2001 | Parkhill et al. | 180/417 |

* cited by examiner

*Primary Examiner*—Charles G. Freay
*Assistant Examiner*—Michael K. Gray
(74) *Attorney, Agent, or Firm*—Brinks Hofer Gilson & Lione

(57) ABSTRACT

An integrated, i.e unitary, rotary hydraulic vane pump assembly reduces cost and simplifies manufacturing thereof. The integrated assembly includes an electric motor, a rotary vane pump, a pump housing and an end bell. The end bell has an inlet fitting or passageway which communicates with the inlet of the rotary vane pump. The pump housing receives the vane pump and is received within the end bell. The electric motor is secured to the face of the pump housing opposite the end bell. The pump housing includes outlet passageways and a centrally disposed axial opening for receiving an output shaft of the electric motor. The rotary vane pump includes end sections and a center, cam ring section which receives a vane rotor assembly coupled to the output shaft.

15 Claims, 4 Drawing Sheets

INTEGRATED VANE PUMP AND MOTOR

BACKGROUND OF THE INVENTION

1. Field of the Invention

The invention relates generally to hydraulic rotary vane pumps and more specifically to a hydraulic rotary vane pump assembly having an integrally mounted drive motor and rotary vane pump.

2. Description of Related Art

In order to improve the operation and efficiency of power steering systems utilizing pressurized hydraulic fluid a current design approach utilizes a hydraulic rotary vane pump directly driven by a variable speed electric motor. Such electro-hydraulic power steering systems (EHPAS) provide improved steering feel, sensitivity, control and reduced energy consumption.

The packaging of such devices, i.e., a dedicated electric motor and hydraulic rotary vane pump, has yet to reach a level of sophistication commensurate with other components of the system. That is, present designs, simply comprehend a cartridge type rotary vane pump mounted upon appropriate stationary vehicle components and an adjacent and operatively associated electric motor similarly secured. In this configuration the pump has its own housing, the motor has its own housing, a coupler for the pump and motor shafts is required and various brackets and fasteners for mounting the pump and motor are required.

Clearly a motor and pump assembly of this type does not represent an efficient package from weight, space and cost standpoints. The current invention relates to an improvement in such assemblies wherein reduced weight and manufacturing simplicity are two of the many benefits enjoyed.

SUMMARY OF THE INVENTION

An integrated, i.e. unitary, rotary hydraulic vane pump assembly reduces cost and simplifies manufacturing thereof. The integrated assembly includes an electric motor, a rotary vane pump, a pump housing and an end bell. The end bell has an inlet fitting or passageway which communicates with the inlet of the rotary vane pump. The pump housing receives the vane pump and is received within the end bell. The electric motor is secured to the face of the pump housing opposite the end bell. The pump housing includes outlet passageways and a centrally disposed axial opening for receiving an output shaft of the electric motor. The rotary vane pump includes end sections and a center, cam ring section which receives a vane rotor assembly coupled to the output shaft.

Thus it is an object of the present invention to provide an integrated, i.e. unitary, rotary vane pump and motor assembly.

It is a further object of the present invention to provide an integrated hydraulic rotary vane pump and motor assembly having common components and features which reduce weight and simplify manufacturing.

It is a still further object of the present invention to provide an integrated rotary hydraulic vane pump assembly disposed within a housing to which an electric drive motor is attached.

Further objects and advantages of the present invention will become apparent by reference to the following description of the preferred embodiment and appended drawings wherein like reference numbers refer to the same component, element or feature.

DETAILED DESCRIPTION OF THE PREFERRED EMBODIMENT

Figure 1:
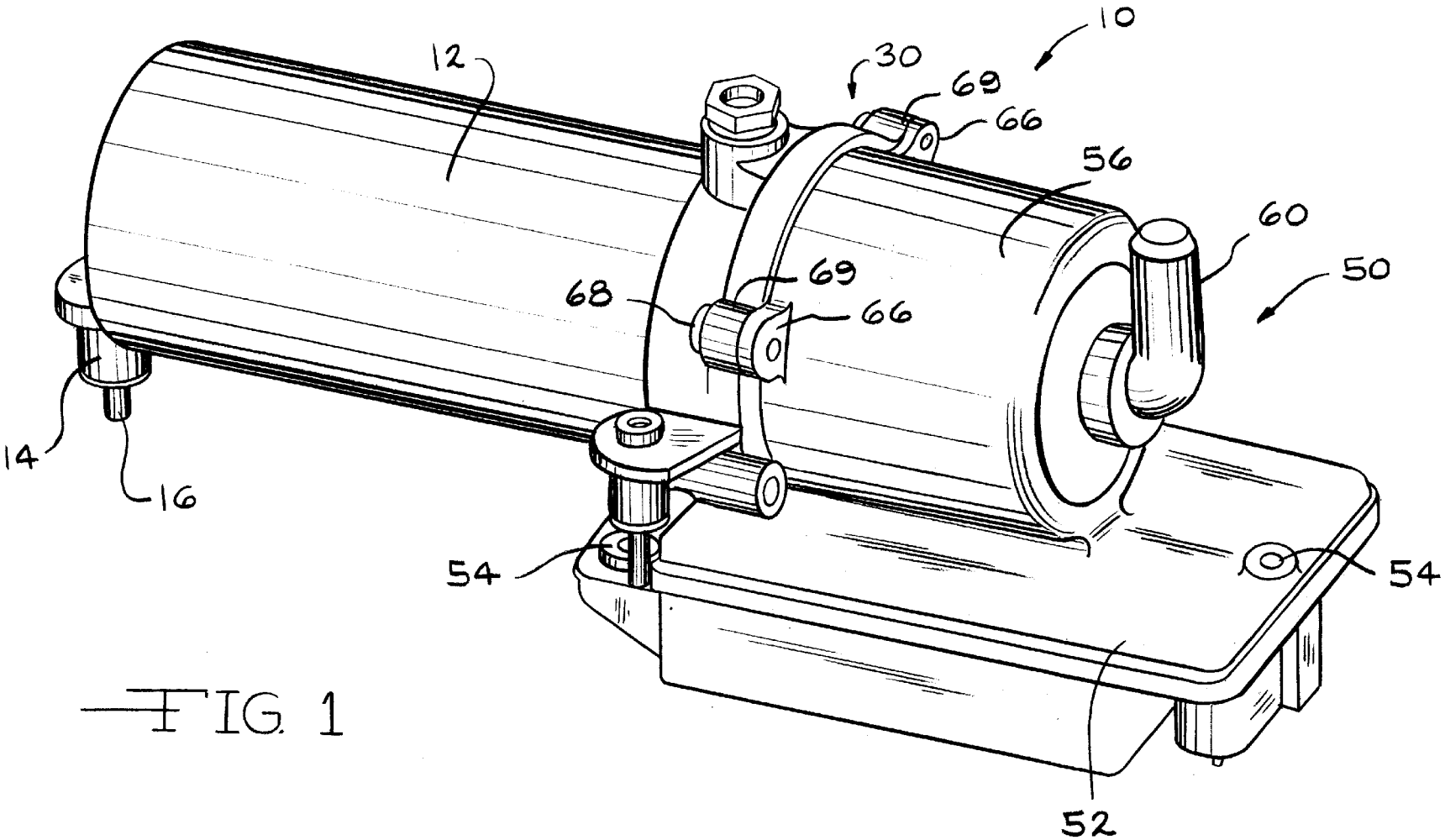
FIG. 1 is a perspective view of an integrated rotary vane pump and motor assembly according the present invention.
Figure 2:
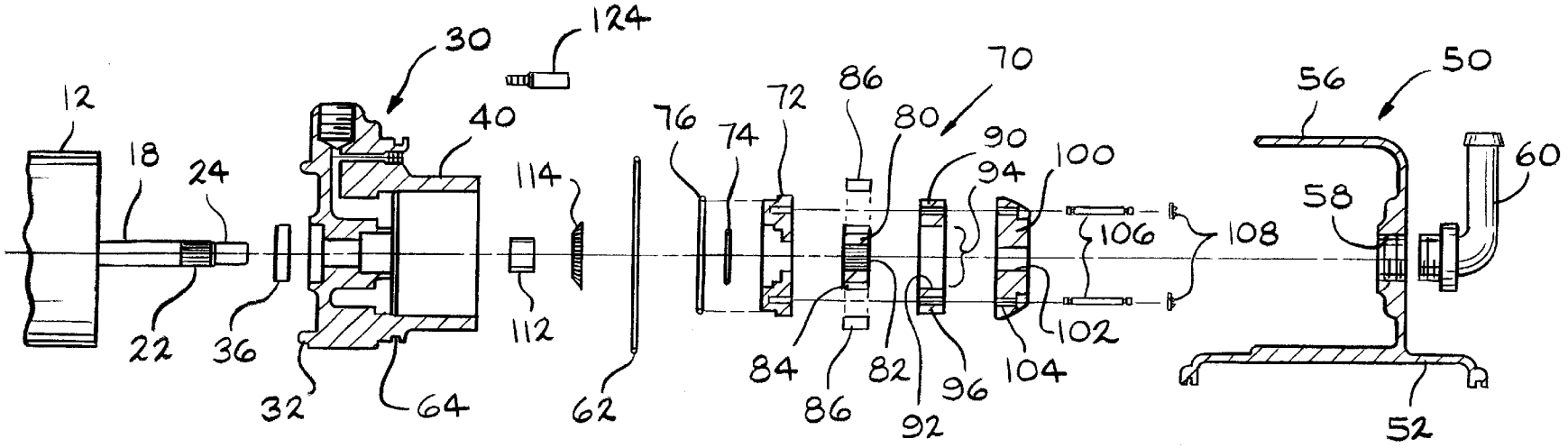
FIG. 2 is a full sectional, exploded view of the integrated rotary vane pump and motor assembly according to the instant invention.

Referring now to FIGS. 1 and 2, an integrated rotary vane hydraulic pump and motor assembly is illustrated and generally designated by the reference number 10. The integrated pump and motor assembly 10 includes an electric motor 12 having an electrical fitting 14 such as a removable connector or seal and an electrical cable 16 which provides electrical energy to the motor 12. Axially extending from the motor 12 is an output shaft 18 having a region of male splines 22 formed thereupon. Adjacent the end of the output shaft 18 is a reduced diameter portion 24.

Figure 3:
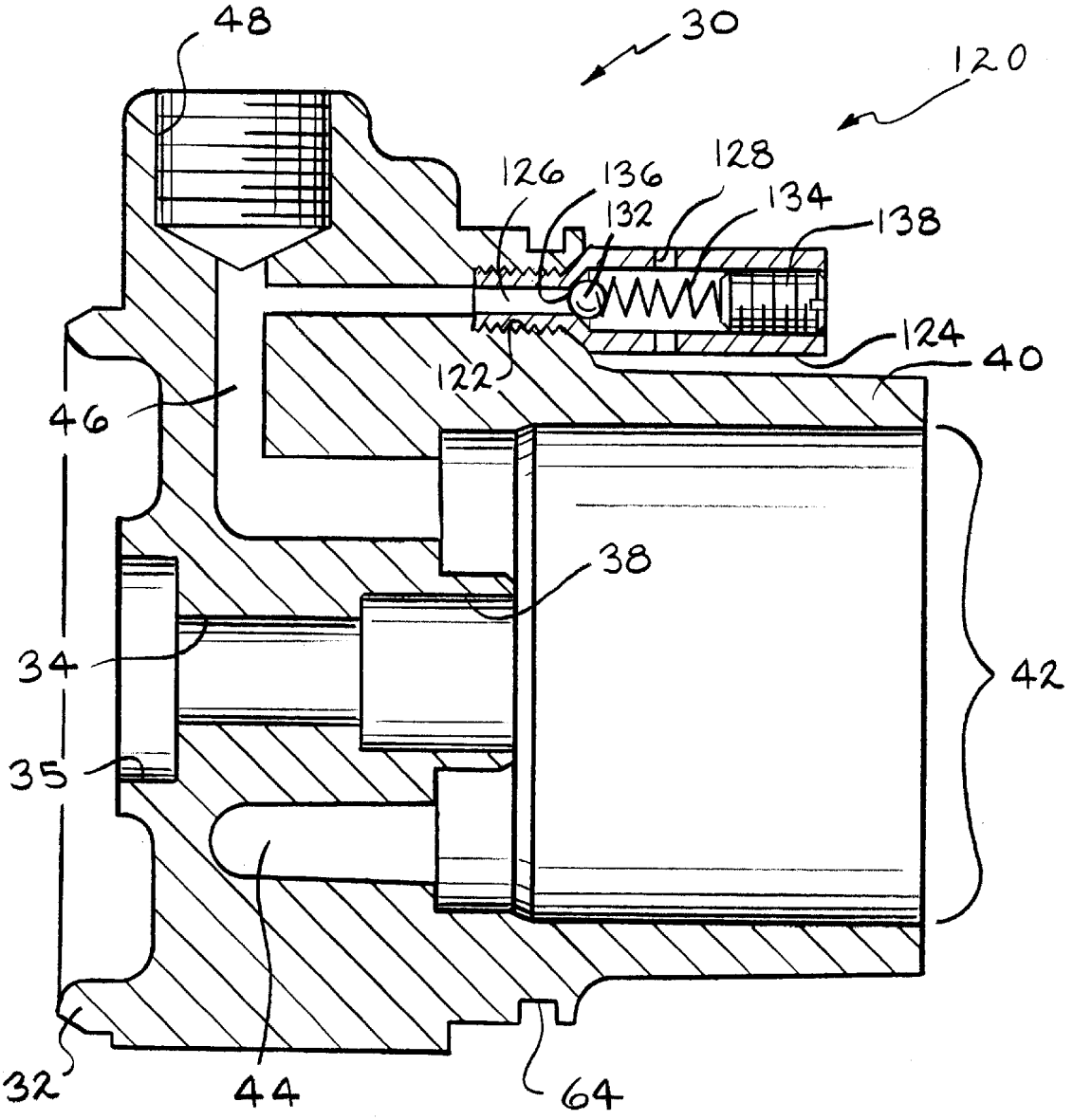
FIG. 3 is an enlarged, full sectional view of a pump housing of the integrated rotary vane pump and motor assembly according to the present invention.

Referring now to FIGS. 1 and 3, the electric motor 12 is attached by suitable fasteners (not illustrated) which preferably extend axially through the electric motor 12 to a pump housing 30. The pump housing 30 includes a cylindrical lip or projection 32 which locates and engages the electric motor 12 and a centrally disposed through passageway 34 which receives the output shaft 18 of the electric motor 12. A first counterbore 35 concentric with the through passageway 34 receives a fluid tight shaft seal 36. A second counterbore 38 is disposed adjacent the end of the through passageway 34 opposite the first counterbore 35. The pump housing 30 also includes a large cylindrical extension 40 which defines an interior cylindrical volume 42 which communicates with an annular outlet chamber 44. The annular outlet chamber 44 is in fluid communication with a radial outlet passageway 46 which provides power steering fluid under pressure to associated power steering components (not illustrated). Preferably, the radial outlet passageway terminates in a threaded opening 48 which is adapted to receive a complementarily threaded male fitting.

As illustrated in FIGS. 1 and 2, the pump housing 30 is received within an end bell assembly 50. The end bell assembly 50 includes a generally planar base 52 having a plurality of mounting holes 54 which receive suitable fasteners (not illustrated) which secure the pump and motor assembly 10 to a suitable feature or component of a motor vehicle. The end bell assembly 50 also includes a cylindrical portion 56 having an inlet opening 58 which is adapted to receive an inlet fitting such as an elbow 60 or other suitable component adapted to accommodate an inlet hose or other fluid carrying component which provides power steering fluid to the inlet opening 58 of the pump and motor assembly 10. An O-ring seal 62 is received within a suitably sized and located circular channel or groove 64 in the pump housing 30 and provides a fluid tight seal between the cylindrical portion 56 of the end bell assembly 50 and the pump housing 30. A plurality of ears or lugs 66 extend radially from the cylindrical portion 56 and are engaged by a like plurality of threaded fasteners 68 extending through a plurality of ears or lugs 69 extending from the pump housing 30. Cooperation between the threaded fasteners 68 and the lugs 66 secures the pump housing 30 and the electric motor 12 to the end bell assembly 50.

Figure 4:
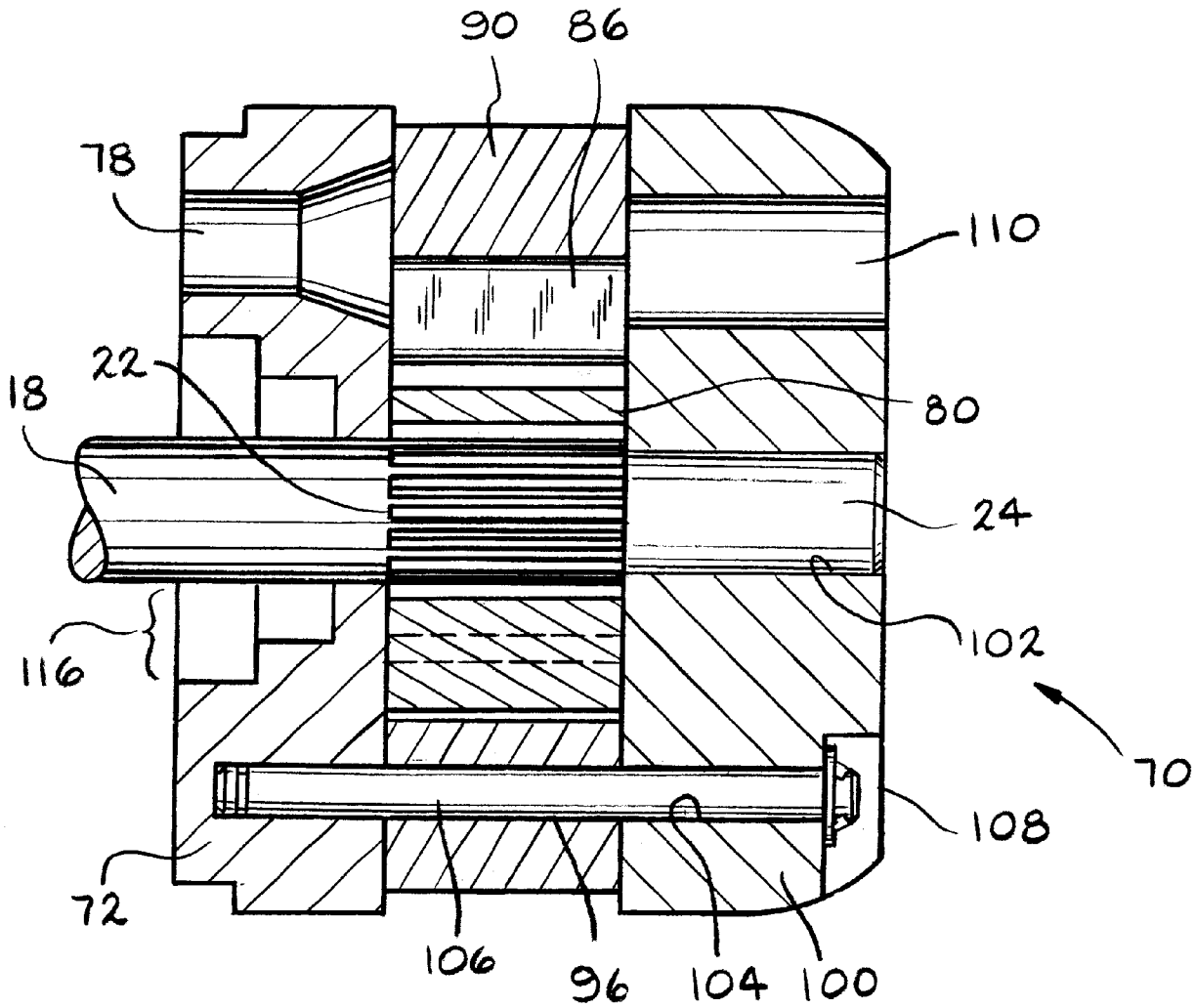
FIG. 4 is an enlarged, full sectional view of a rotary vane pump of an integrated rotary vane pump and motor assembly according to the present invention.

Referring now to FIGS. 2 and 4, the integrated pump and motor assembly 10 also preferably includes a cartridge type rotary vane pump assembly 70. While a cartridge type rotary vane pump assembly 70 is described herein, it will be appreciated that such description is illustrative and exemplary only and that other types and configurations of rotary vane pumps may be utilized in the present invention. The cartridge type rotary vane pump assembly 70 includes a first or base section 72 which, through the agency of a first 0-ring seal 74 and a second O-ring seal 76, seals against aligning surfaces of the pump housing 30 such that high pressure, outlet flow through a pair of outlet passageways 78 in the first section 72 is directed into the outlet annulus 44 without leakage.

The rotary vane pump assembly 70 also includes a rotor 80 having a splined interior passageway 82 and a plurality of radial slots 84 which open around its periphery and receive a like plurality of vanes 86. The rotor 80 and the vanes 86 are received within a cam ring 90 having an interior surface 92 which defines a pumping chamber 94. The interior surface 92 has alternating larger and smaller diameter regions of dwell and intermediate regions of increasing and decreasing diameter which define intake and pumping regions, respectively. A pair of parallel spaced-apart axial passageways 96 extend through the cam ring 90.

A second or top section 100 completes the pump assembly 70 and includes a through opening 102 which receives the reduced diameter portion 24 of the shaft 18. The top section 100 also includes a pair of parallel through axial passageways 104 which receive a pair of mounting rods or pins 106 which seat within the first section 72 and receive retaining spring clips 108 such as Tinnerman nuts or similar spring fasteners which secure the components of the pump assembly 70 together. The top section 100 also defines a pair of inlet or intake ports 110, one of which is illustrated in FIG. 4.

Referring now to FIGS. 2 and 3, at the interface between the pump housing 30 and the rotary vane pump assembly 70 and received within the second counterbore 38 is a needle bearing assembly 112. The needle bearing assembly 112 freely rotatably supports the output shaft 18 of the electric motor 12 in the region between the electric motor 12 and the rotary vane pump assembly 70. Adjacent the needle bearing assembly 112 is a Belleville washer 114 which seats within a stepped portion 116 of the first or base section 72 of the rotary vane pump assembly 70. It will be appreciated that it is necessary for the rotary vane pump assembly 70 to be restrained against rotation within the cylindrical volume 42 of the cylindrical extension 40. This may be readily achieved by forming one or more axially oriented keyways in the interior surface of the cylindrical extension 40 and including one or more complementarily sized and configured projections on one or more of the sections of the rotary vane pump assembly 70. A snap ring may be utilized to retain the rotary vane pump assembly 70 within the cylindrical extension 40. Alternatively, one or more radially oriented pins may be disposed in radial opening in the wall of the cylindrical extension 40 to engage and restrain the rotary vane pump assembly 70 against both axial and rotational motion.

Preferably, the integrated pump and motor assembly 10 also includes a bypass or pressure relief valve assembly 120. The pressure relief valve assembly 120 is received within a threaded passageway 122 which is in fluid communication with the radial outlet passageway 46 in the pump housing 30. The pressure relief valve assembly 120 includes a cylindrical body 124 having an axial passageway 126 in fluid communication with the threaded passageway 122 and at least a pair of opposed radial ports 128. A ball bearing 132 or similar device is biased by a compression spring 134 against a valve seat 136 and both components are retained within the cylindrical body 124 by a plug or cap 138. As pressure within the radial outlet passageway 46 increases beyond a predetermined limit, the ball bearing 132 is lifted off the seat 136 and power steering fluid flows past the ball bearing 132, out the radial ports 128 and into the interior of the cylindrical portion 56 of the end bell housing 50.

In operation, the integrated vane pump and motor 10 according to the present invention receives return hydraulic or power steering fluid through the inlet elbow 60 and the inlet opening 58 which fills the cylindrical portion 56 of the end bell assembly 50 around the cartridge type rotary vane pump assembly 70. Fluid is drawn into the rotary vane pump assembly 70 through the inlet or intake ports 110. The hydraulic or power steering fluid is pumped by the vanes 86 in the rotor 80 and exits the rotary vane pump assembly 70 under high pressure through the outlet passageways 78, through the outlet annulus 44 and out through the radial outlet passageway 46. As noted previously, should pressure in the outlet passageway 46 rise above a predetermined maximum, the pressure relief valve assembly 120 relieves such pressure and allows hydraulic or power steering fluid to return to the interior of the cylindrical portion 56 of the end bell assembly 50.

The foregoing disclosure is the best mode devised by the inventors for practicing this invention. It is apparent, however, that apparatus incorporating modifications and variations will be obvious to one skilled in the art of rotary vane pumps. Inasmuch as the foregoing disclosure presents the best mode contemplated by the inventors for carrying out the invention and is intended to enable any person skilled in the pertinent art to practice this invention, it should not be construed to be limited thereby but should be construed to include such aforementioned obvious variations and be limited only by the spirit and scope of the following claims.

We claim:

1. An integrated pump and motor assembly comprising, in combination, an electric motor having an output shaft, a pump housing having an opening for receiving said output shaft and a cylindrical extension adapted to receive a pump, an end bell adapted to receive said cylindrical extension, a rotary vane pump disposed in said cylindrical extension, said vane pump including a first end section having an outlet port, a cam ring section, a second end section defining an inlet port, at least one mounting rod extending through said end sections and said cam ring section and a rotor assembly disposed within said cam ring and operably coupled to said output shaft.

2. The integrated pump and motor assembly of claim 1 wherein said end bell includes a mounting plate having a plurality of openings adapted to receive fasteners.

3. The integrated pump and motor assembly of claim 1 wherein said end bell includes an inlet opening.

4. The integrated pump and motor assembly of claim 1 wherein said output shaft includes male splines and said rotor assembly includes a rotor having female splines.

5. The integrated pump and motor assembly of claim 1 wherein said pump housing includes an outlet passageway and further including a pressure relief valve in fluid communication with said outlet passageway.

6. The integrated pump and motor assembly of claim 1 further including a fluid seal between said end bell and said pump housing.

7. The integrated pump and motor assembly of claim 1 wherein said electric motor is secured to said pump housing.

8. An integrated pump and motor assembly comprising, in combination, an electric motor having an output shaft, a pump housing having an opening for receiving said output shaft and a concentric cylindrical extension defining a pump receiving region, an end bell adapted to receive said cylindrical extension, a fluid seal between said end bell and said pump housing, a rotary vane pump disposed in said cylindrical extension, said vane pump including a first end section having an outlet port, a cam ring section, a second end section defining an inlet port, at least one mounting rod extending through said end sections and said cam ring section and a rotor assembly disposed within said cam ring and operably coupled to said output shaft.

9. The integrated pump and motor assembly of claim 8 wherein said end bell includes a mounting base having a plurality of openings adapted to receive fasteners.

10. The integrated pump and motor assembly of claim 8 wherein said end bell includes an inlet opening.

11. The integrated pump and motor assembly of claim 8 wherein said output shaft includes male splines and said rotor assembly includes a rotor having female splines.

12. The integrated pump and motor assembly of claim 8 wherein said pump housing includes an outlet passageway and further including a pressure relief valve in fluid communication with said outlet passageway.

13. The integrated pump and motor assembly of claim 8 further including a fluid tight seal between said end bell and said pump housing.

14. The integrated pump and motor assembly of claim 8 wherein said electric motor is secured to said pump housing.

15. The integrated pump and motor assembly of claim 8 wherein said fluid seal is an O-ring.

* * * * *